US010109446B2

(12) United States Patent
Longoni et al.

(10) Patent No.: US 10,109,446 B2
(45) Date of Patent: Oct. 23, 2018

(54) AIR-STABLE ALKALI OR ALKALINE-EARTH METAL DISPENSERS

(75) Inventors: Giorgio Longoni, Monza (IT); Marco Amiotti, Cornaredo (IT)

(73) Assignee: SAES GETTERS S.P.A., Lainate MI (IT)

( * ) Notice: Subject to any disclaimer, the term of this patent is extended or adjusted under 35 U.S.C. 154(b) by 1763 days.

(21) Appl. No.: 12/526,307

(22) PCT Filed: Feb. 12, 2008

(86) PCT No.: PCT/IB2008/000307

§ 371 (c)(1),
(2), (4) Date: Aug. 7, 2009

(87) PCT Pub. No.: WO2008/099256

PCT Pub. Date: Aug. 21, 2008

(65) Prior Publication Data

US 2010/0104450 A1 Apr. 29, 2010

(30) Foreign Application Priority Data

Feb. 16, 2007 (IT) ..... MI2007A0301

(51) Int. Cl.

| | |
|---|---|
| ***B65D 81/22*** | (2006.01) |
| ***H01J 7/20*** | (2006.01) |
| ***H01J 7/18*** | (2006.01) |

(52) U.S. Cl.

CPC ..... *H01J 7/20* (2013.01); *H01J 7/183* (2013.01)

(58) Field of Classification Search

CPC ..... H01J 7/186; C23C 14/24
USPC ..... 313/545, 546, 549, 548, 550, 551, 547, 313/553, 561; 417/48; 204/192.32; 118/726–727

See application file for complete search history.

(56) References Cited

U.S. PATENT DOCUMENTS

| | | | | |
|---|---|---|---|---|
| 2,824,640 | A | 2/1958 | Della Porta | |
| 2,943,181 | A * | 6/1960 | Gunow et al. | 219/85.17 |
| 3,203,901 | A | 8/1965 | Della Porta | |
| 3,443,915 | A * | 5/1969 | Poston et al. | 430/5 |
| 3,579,459 | A | 5/1971 | Della Porta et al. | |
| 3,672,987 | A * | 6/1972 | O'Keeffe et al. | 427/75 |

(Continued)

FOREIGN PATENT DOCUMENTS

| | | |
|---|---|---|
| CN | 1146936 | 4/1997 |
| CN | 1288247 A | 3/2001 |

(Continued)

OTHER PUBLICATIONS

Werner Espe et al., "Getter Materials", Electronics, VNU Business Publications, vol. 23, pp. 80-86 (1950).

(Continued)

*Primary Examiner* — Jacob K Ackun
*Assistant Examiner* — Jenine Pagan
(74) *Attorney, Agent, or Firm* — Steinfl + Bruno LLP

(57) ABSTRACT

There are described dispensers (10; 20; 30; 40; 50; 60) of alkali or alkaline-earth metals, comprising deposits of getter materials (13; 23; 33; 43; 53; 63) and alkali or alkaline-earth metal sources (12, 22; 32; 42; 53; 63), in which the sources of alkali or alkaline-earth metal are protected from environmental gases by said deposits of getter materials.

14 Claims, 3 Drawing Sheets

(56) References Cited

U.S. PATENT DOCUMENTS

| | | | | | |
|---|---|---|---|---|---|
| 3,840,766 | A * | 10/1974 | Pappas | H01J 61/26 | 313/554 |
| 4,049,443 | A * | 9/1977 | Hatterer et al. | 420/590 | |
| 4,071,335 | A | 1/1978 | Barosi | | |
| 4,306,887 | A | 12/1981 | Barosi et al. | | |
| 4,312,669 | A | 1/1982 | Boffito et al. | | |
| 4,642,516 | A | 2/1987 | Ward et al. | | |
| 4,665,343 | A | 5/1987 | Ferrario et al. | | |
| 4,668,424 | A | 5/1987 | Sandrock | | |
| 5,066,888 | A | 11/1991 | Van Der Marel et al. | | |
| 5,118,952 | A * | 6/1992 | Sakamoto et al. | 250/492.2 | |
| 5,961,750 | A | 10/1999 | Boffito et al. | | |
| 6,468,043 | B1 | 10/2002 | Benvenuti | | |
| 6,534,202 | B2 * | 3/2003 | Sato et al. | 428/690 | |
| 6,583,559 | B1 | 6/2003 | Carretti et al. | | |
| 6,753,648 | B2 | 6/2004 | Boffito et al. | | |
| 6,876,123 | B2 | 4/2005 | Martinovsky et al. | | |
| 7,072,091 | B2 * | 7/2006 | Udaka et al. | 359/265 | |
| 7,176,429 | B2 | 2/2007 | Suyama et al. | | |
| 7,534,635 | B1 * | 5/2009 | Foust et al. | 438/25 | |
| 7,842,194 | B2 * | 11/2010 | Giannantonio et al. | 252/181.4 | |
| 2002/0173068 | A1 * | 11/2002 | Kido et al. | 438/99 | |
| 2004/0001916 | A1 | 1/2004 | Boffito et al. | | |
| 2004/0206205 | A1 * | 10/2004 | Boffito et al. | 75/591 | |
| 2004/0212297 | A1 * | 10/2004 | Nakamura | H01L 51/5221 | 313/504 |
| 2004/0235209 | A1 * | 11/2004 | Hasegawa et al. | 438/21 | |
| 2005/0145179 | A1 * | 7/2005 | Cattaneo et al. | 118/726 | |
| 2005/0184603 | A1 | 8/2005 | Martsinovsky | | |
| 2006/0257296 | A1 * | 11/2006 | Lipp | 422/159 | |
| 2006/0275063 | A1 * | 12/2006 | Blair | G03G 15/2057 | 399/333 |
| 2007/0034809 | A1 | 2/2007 | Lal et al. | | |
| 2007/0170846 | A1 * | 7/2007 | Choi et al. | 313/504 | |
| 2008/0042102 | A1 | 2/2008 | Cattaneo et al. | | |
| 2010/0104450 | A1 | 4/2010 | Longoni et al. | | |

FOREIGN PATENT DOCUMENTS

| | | | | |
|---|---|---|---|---|
| CN | 1656625 | A | 8/2005 | |
| EP | 0 360 317 | A1 | 3/1990 | |
| EP | 0719609 | | 7/1996 | |
| EP | 719609 | A2 * | 7/1996 | B22F 1/00 |
| EP | 1 261 043 | A2 | 11/2002 | |
| EP | 1 598 844 | A1 | 11/2005 | |
| EP | 1 670 031 | A1 | 6/2006 | |
| EP | 1 865 283 | A1 | 12/2007 | |
| EP | 2115762 | B1 | 6/2011 | |
| GB | 262 069 | A | 6/1927 | |
| JP | 02-106845 | A | 4/1990 | |
| JP | 10-088322 | A | 4/1998 | |
| JP | 2004-532932 | A | 10/2004 | |
| JP | 2006128717 | | 5/2006 | |
| JP | 2010519017 | | 6/2010 | |
| KR | 20090112759 | | 10/2009 | |
| TW | 200621638 | A | 7/2006 | |
| TW | 200900238 | | 1/2009 | |
| TW | I388501 | | 3/2013 | |
| WO | 2003/103069 | A2 | 12/2003 | |
| WO | 2004/065289 | A2 | 8/2004 | |
| WO | 2005027178 | A1 | 3/2005 | |
| WO | 2006/027814 | A2 | 3/2006 | |
| WO | 2006/057021 | A1 | 6/2006 | |
| WO | 2006/084113 | A2 | 8/2006 | |
| WO | 2006/109343 | A2 | 10/2006 | |

OTHER PUBLICATIONS

Y. Hishinuma et al., "Refrigeration by combined tunneling and thermionic emission in vaccum: Use of nanometer scale design", Applied Physics Lettters, vol. 78, No. 17, pp. 2572-2574 (2001).

Li-Anne Liew et al., "Microfabricated alkali atom vapor cells", Applied Physics Letters, vol. 84, No. 14, pp. 2694-2696 (2004).

Int'l Search Report dated Jul. 4, 2008 in Int'l Application No. PCT/IB2008/000307.

Int'l Preliminary Report on Patentability dated Jun. 12, 2009 in Int'l Application No. PCT/IB2008/000307.

Office Action dated Jun. 1, 2010 in CN Application No. 200880005170.1.

Office Action dated Feb. 21, 2012 in JP Application No. 2009-549861.

Office Action dated Dec. 31, 2011 in CN Application No. 200880005170.1.

Communication dated Dec. 18, 2009 in EP Application No. 08 719 130.0.

Result of telephone consultation dated Dec. 1, 2010 in EP Application No. 08 719 130.0.

Office Action dated Jul. 18, 2013 for Taiwanese Patent Application No. 097105038 filed on Feb. 13, 2008 in the name of SAES Getters SPA (English + Chinese).

Taiwan IPO Search Report dated Jul. 18, 2013 for Taiwanese Patent Application No. 097105038 filed on Feb. 13, 2008 in the name of SAES Getters SPA (English + Chinese).

Notice to File a Response dated Oct. 15, 2013 for Korean Patent Application No. 2009-7019246 filed on Sep. 15, 2009 filed in the name of SAES Getters SPA (English + Korean).

Notice of Reasons for Rejection dated Mar. 5, 2013 for Japanese Patent Application No. 2009-549861 filed on Aug. 21, 2008 filed in the name of SAES Getters SPA (English + Japanese).

Daintith, J. "Element" A Dictionary of Chemistry. 4th ed. Oxford: Oxford UP, 2000. p. 206.

Notification of Reexamination dated Mar. 4, 2014 for Chinese Patent Application 200880005170.1 filed on Feb. 12, 2008 in the name of SAES Getters SPA (English + Chinese).

Notice to File a Response dated Jan. 26, 2014 for Korean Patent Application No. 2009-7019246 filed on Sep. 15, 2009 filed in the name of SAES Getters SPA (English +Korean).

Connelly, N.G., et al., "Elements in the Periodic Table", *Nomenclature of Inorganic Chemistry: IUPAC Recommendations 2005*, International Union of Pure and Applied Chemistry, 2005, RSC Publishing, p. 51.

Merriam-Webster Online Dictionary, "Elemental", http://web.archive.org/web/20060425135754/http://merriam-webster.com/dictionary/elemental. Apr. 26, 2006, Downloaded on Oct. 9, 2015. 1 pg.

Written Opinion dated Jul. 4, 2008 for PCT/IB2008/000307 application filed in the name of SAES Getters S.P.A. on Feb. 12, 2008, 8 pages.

Third Office Action for Chinese Patent Application No. 200880005170.1 filed Feb. 12, 2008 on behalf of SAES Getters S.P.A. dated Aug. 21, 2014 (Chinese original + English translation), 34 pages.

Office Action and Search Report for Taiwanese Application No. 097105038, filed Feb. 13, 2008 on behalf of SAES Getters S.P.A. dated Jul. 18, 2013 (Chinese original + English translation), 12 pages.

* cited by examiner

AIR-STABLE ALKALI OR ALKALINE-EARTH METAL DISPENSERS

CROSS-REFERENCE TO RELATED APPLICATIONS

This application is a Section 371 of International Application No. PCT/IB2008/000307, filed Feb. 12, 2008, which was published in the English language on Aug. 21, 2008 under International Publication No. WO 2008/099256 A1, and the disclosure of which is incorporated herein by reference.

BACKGROUND OF THE INVENTION

The present invention is about alkali or alkaline-earth metal dispensers stable to environmental gases, in particular air, especially adapted for use in the fabrication of miniaturized devices.

A number of industrial applications require the presence of alkali or alkaline-earth metals in different physical forms, e.g., in the form of thin solid films deposited onto a surface of a device or in the form of vapors. Among these, one can remember photocathodes, in which the active element is a surface made of an alkali metal (or of an intermetallic compound containing an alkali metal); CRTs, in which a deposit of an alkaline-earth metal (typically barium) on the inner surface of the tube acts as a trap for gases, keeping the required degree of vacuum inside the same tube; atomic clocks, in which an electromagnetic radiation is passed through vapors of an alkali metal (rubidium or, more commonly, cesium); atomic interferometers, described in International Patent Application No. WO 2006/084113, and atomic gyroscopes, described in European patent application No. EP 1865283; and refrigeration units based on the tunnel effect, in which cooling is due to transport of electrons between a cathode and an anode, and a deposit of an alkali metal on at least the electron-emitting surface of the cathode helps reduce the work function of the cathode and consequently the energy required for operating the system. Detailed information about this mechanism, called "thermotunneling", can be found in the article "Refrigeration by combined tunneling and thermionic emission in vacuum: use of nanometer scale design" of Y. Hishinuma et al., published in Applied Physics Letters, vol. 78, no. 17, pages 2572-2574 (2001), while an example of use in an actual device is given in U.S. Pat. No. 6,876,123 B2.

Alkali or alkaline-earth metals are not easy to handle or ship due to their high reactivity towards atmospheric gases and moisture. Dispensers of these metals, used for a long time, contain them in the form of stable compounds. Dispensers of alkali metals, in which these metals are present in form of their salts (e.g., chromates, vanadates, titanates and similar) are described, for instance, in U.S. Pat. Nos. 3,579,459 and 6,753,648 B2, and in European patent application No. EP 1598844 A1; dispensers of barium, containing the stable compound $BaAl_4$, are described in a number of patents including, to cite but a few, U.S. Pat. Nos. 2,824,640 and 4,642,516; dispensers of calcium, containing the compound $CaAl_2$, are described e.g., in U.S. Pat. No. 6,583,559 B1.

All of the dispensers disclosed in the above cited documents are however bulky, and not suitable for use in the production of, or for insertion in, miniaturized devices, such as for instance the thermotunneling refrigerating units described in the Hishinuma article cited above, or in miniaturized atomic clocks, such as those described in the paper "Microfabricated alkali atom vapor cells" of Li-Anne Liew et al. (Applied Physics Letters, vol. 84, no. 14, pages 2694-2696 (2004)).

For their proper working, it is necessary for the previously cited industrial applications that the inner cavity of the devices be kept under vacuum or anyway free from reactive gases. In the case of a thermotunneling refrigerating unit, the presence of gases between the cathode and the anode could hinder the traveling of electrons, and could cause the back-transfer of heat by convection. These units generally require a vacuum better than $10^{-1}$ hectoPascal (hPa) and preferably in the range of $10^{-4}$ hPa. In the case of atomic clocks, gases present in the cavity could react with the vapors of the alkali metal, thus causing the diminishing of the amount of free metal vapor and worsening of the working of the clock. Despite the fact that the manufacturing processes of these (and other) devices commonly comprise steps of evacuation of the cavities, phenomena like permeation from outside, leaks, and outgassing from the surfaces of said cavities reintroduce undesired gases in the same during the device life. In order to tackle this problem, it is known to add getter materials inside cavities, that is, materials capable of chemically reacting and thus strongly fixing gaseous species. Getter materials are generally metals like titanium, zirconium, vanadium, hafnium or niobium, or alloys of these (and mainly of titanium and/or zirconium) with one or more metals chosen among transition elements, Rare Earths and aluminum.

BRIEF SUMMARY OF THE INVENTION

The objects of the present invention are to provide alkali or alkaline-earth metal dispensers stable to environmental gases, in particular air, and especially adapted for use inside miniaturized devices, or in the processes for the manufacturing of the same devices, as well as to provide processes for the production of said dispensers.

These and other objects are achieved according to the present invention which, in a first aspect thereof, relates to a dispenser of an alkali or alkaline-earth metal, characterized by comprising a support carrying a deposit of a getter material and in that the alkali or alkaline-earth metal is present in the dispenser in the form of elemental metal protected from the environment by said deposit of getter material.

The dispensers of the invention may be realized according to two main modalities. In the first modality the alkali or alkaline-earth metal is present in the dispenser in the form of a deposit of said metal, completely covered by the deposit of getter material. In the second modality the alkali or alkaline-earth metal is dispersed inside at least part of the deposit of getter material.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
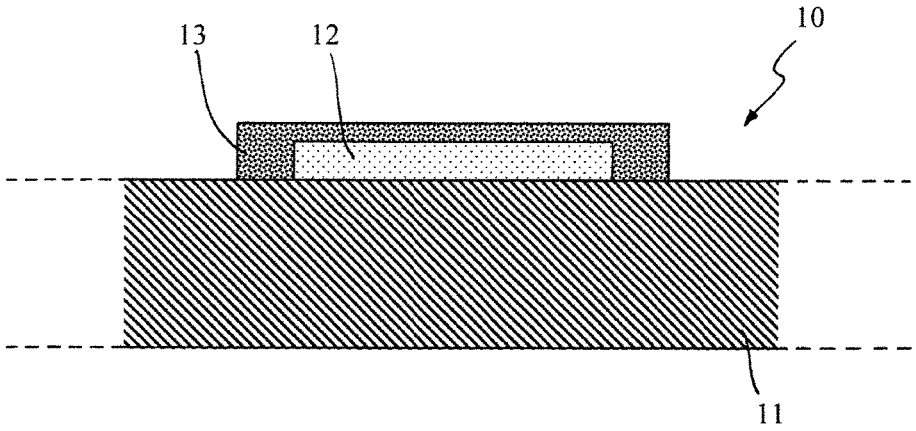
FIG. 1 represents a sectional and cut-away view of a dispenser of the invention realized according to a first modality.

In the drawings, dimensions and dimensional ratios of the various elements represented are not correct, but rather altered for the sake of readability of the figures. In particular, the heights of the deposits of getter material and of the deposits of alkali or alkaline-earth metals have been strongly increased in order to make the representation of such elements comprehensible.

The support of the dispensers of the invention may be realized with a wide variety of materials, provided that they are compatible both with the process of production of the dispensers and with the processes of production of the devices in which the dispensers are used. The most suitable materials for realizing the support are metals, metal alloys, semiconductors, glasses or ceramic materials, and in particular kovar (an alloy based on iron, nickel, cobalt and minor percentages of other elements), silicon, germanium, silicon carbide, sapphire, quartz, glass, pyrex, indium phosphide and gallium arsenide. It is also possible, however, that applications arise in which the support may be realized with other materials, such as polymers (e.g., in the form of foils).

Dispensers according to the invention can be produced for the release of essentially any alkali or alkaline-earth metals. Beryllium is less preferred due to its high evaporation temperature and toxicity, and francium and radium due to their radioactivity, but it is not excluded that dispensers of these metals may be produced according to the invention. For use in common industrial applications, the most preferred metals are lithium, sodium, potassium, rubidium, cesium, magnesium, calcium, strontium and barium.

In the rest of the description, for the sake of brevity, alkali and alkaline-earth metals will also be simply referred to as evaporable metals. Furthermore, in parts of the following description reference will be made, as an example, to the use of cesium, but any teachings can be applied to the other evaporable metals as well.

The getter materials suitable for the realization of the invention may be constituted by a single metal, or they may have a multi-metal composition. In the case of a single metal, this may be hafnium, niobium, vanadium, and preferably either titanium or zirconium. In the case of multi-metal materials, generally are used alloys based on titanium and/or zirconium with at least another element chosen among the transition elements, Rare Earths and aluminum, such as the Zr—Al alloys described in U.S. Pat. No. 3,203,901 (particularly the alloy of weight percent composition Zr 84%-A16%), the Zr—Ni alloys of U.S. Pat. No. 4,071,335 (particularly the alloy of weight composition Zr 75.7%-Ni 24.3%), the Zr—Fe alloys of U.S. Pat. No. 4,306,887 (particularly the alloy of weight composition Zr 76.6%-Fe 23.4%), the Zr—V—Fe alloys of U.S. Pat. No. 4,312,669 (particularly the alloy of weight composition Zr 70%-V 24.6%-Fe 5.4%), the Zr—Ni-A-M alloys (where A stands for one or more Rare Earth elements and M stands for one or more elements chosen among cobalt, copper, iron, aluminum, tin, titanium and silicon) of U.S. Pat. No. 4,668,424, the alloys Zr—Co-A, in which A is an element chosen among yttrium, lanthanum, Rare Earths or mixtures thereof, of U.S. Pat. No. 5,961,750 (particularly the alloy of weight composition Zr 80.8%-Co 14.2%-A 5%) and, finally, the Zr—V—Ti alloys of U.S. Pat. No. 6,468,043 B1. As known in the field, getter materials require for their proper working a thermal treatment, referred to as activation, at temperatures comprised between about 300 and 600° C. (depending on the specific composition of the material). This treatment causes the diffusion of the atoms of oxygen, nitrogen, or carbon, sorbed by the getter surface soon after its production, towards the inner part of the grains of the material, thus exposing a fresh surface of metal atoms, active in the sorption of gases.

FIG. 1 represents a sectional view of a support of the invention realized according to its first modality, in its more general embodiment.

Dispenser 10 comprises a support 11 onto which is formed a deposit 12 of cesium completely covered by a deposit 13 of a getter material. The thickness of the cesium deposit is comprised between 1 and 100 nanometers (nm) and preferably between 10 and 50 nm, while the getter material deposit has a thickness comprised between 100 nm and 10 micrometer (μm) and preferably between 200 nm and 5 μm or between 100 nm and 1 μm.

With this configuration, the deposit 13 of getter material, jointly with support 11, protects cesium deposit 12 both mechanically and chemically. Mechanically, the getter deposit avoids, for instance, that the cesium deposit moves on support 11 following melting that could take place during the process of production of the final devices in which cesium is to be released. Chemically, the getter sorbs the traces of noxious gases possibly present during said process and avoids reaction of cesium with them.

The same heating treatment that fractures the deposit of getter material causes its activation as well, so that at the time of cesium evaporation the environment inside the cavity is essentially free of potentially noxious gas impurities. In the specific case of thermotunneling refrigerating units, however, even a non-complete getter activation at the time of cesium evaporation is acceptable, because the oxidation of the thin film of metal deposited onto the cathode further improves the work function value of the same, with a lowering from 2.14 to 1.2 eV passing from metallic cesium to its oxide.

The dimensions of the getter material deposit are not necessarily uniform around the cesium deposit, and in particular the thickness of getter material on the lateral sides of the cesium deposit may be greater than the thickness of the layer above the cesium deposit.

Figure 2:
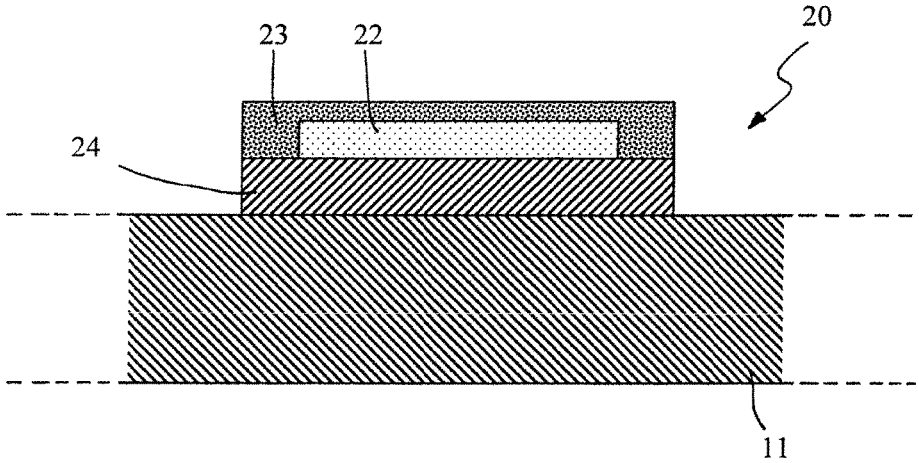
FIGS. 2 through 4 represent sectional and cut-away views of dispensers constituting alternative embodiments of the invention in its first modality.
Figure 3:
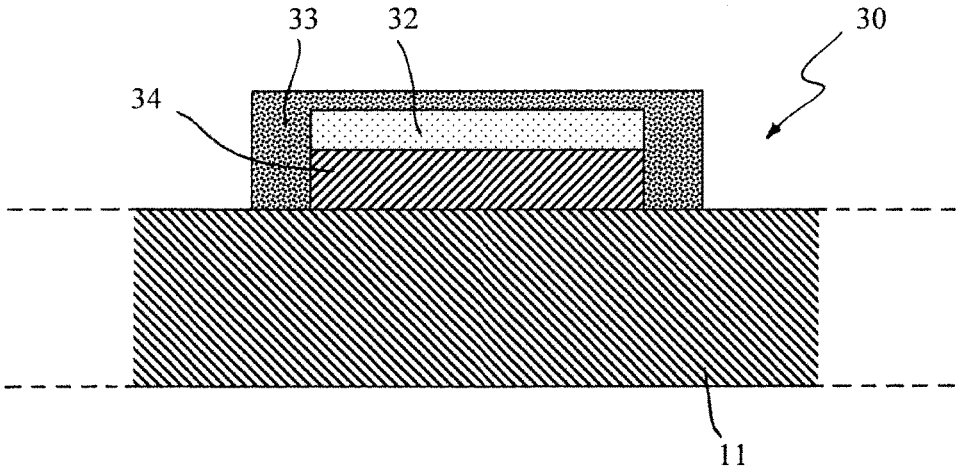
Figure 4:
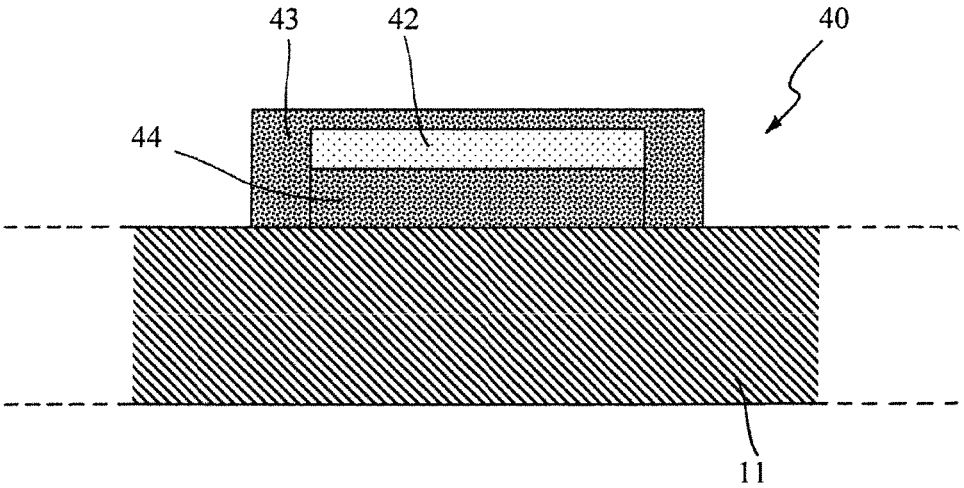

FIGS. 2 to 4 show preferred alternative embodiments of the dispenser generically illustrated in FIG. 1.

FIG. 2 shows in section and cut-away view a dispenser of the invention, 20, according to a first preferred embodiment. In this case the cesium deposit, 22, does not directly contact support 11, but rather between this support and the cesium deposit is interposed a barrier layer, 24, whose function is to avoid cesium diffusion into the support material, which could cause a reduced evaporation yield; above deposit 22 is present a deposit 23 of getter material. The lateral dimensions on support 11 of deposit 23 and layer 24 are the same, and these completely surround the cesium deposit.

For the thickness of the deposits of cesium and getter material, the same values previously given hold, while the thickness of the barrier layer 24 may be comprised between about 100 nm and 10 μm, preferably between 100 nm and Suitable materials are tantalum, platinum, gold (or combinations of these), any of the previously mentioned getter materials, titanium nitride and silicon nitride.

FIG. 3 shows in section and cut-away view a dispenser of the invention, 30, according to a second preferred embodiment. In this case barrier layer 34 and cesium deposit 32 have the same lateral dimensions, and are both surrounded by the getter material deposit 33 that is in contact with the support 11. The barrier layer is thus in contact with the getter material only laterally, while the cesium deposit is confined above and laterally by the getter material, and below by the barrier layer. This second embodiment turns out to be even more preferred because its production process is more convenient than that of the dispenser of FIG. 2, as explained in detail later.

FIG. 4 shows a variation of the dispenser of FIG. 3. In this dispenser, 40, both upper deposit 43 and barrier layer 44, which together completely surround the cesium deposit 42, are made of getter material (preferably but not necessarily of same composition). This embodiment has the advantage of increasing the amount of getter material and thus its capability to sorb impurities. The thickness of the barrier layer 44 is preferably higher than the thickness of deposit 43 covering the cesium deposit. This condition guarantees the efficiency of layer 44 as a barrier, because during heating of the system cesium should cross a higher getter material thickness to reach support 11 than for crossing deposit 43; this is also helped by the fact that deposit 43 fractures more easily than layer 44 because the latter is restrained in its lateral movements by adhesion to the support itself. Both deposit 43 and layer 44 may have a thickness comprised between 100 nm and 10 μm, while the cesium deposit has the same thickness values given above. Though FIG. 4 represents a variation of FIG. 3, this measure (getter material used both for deposit 43 and layer 44) could be adopted also for the production of a deposit as described with reference to FIG. 2 (namely, with the barrier layer and the getter deposit having the same lateral dimensions).

Figure 5:
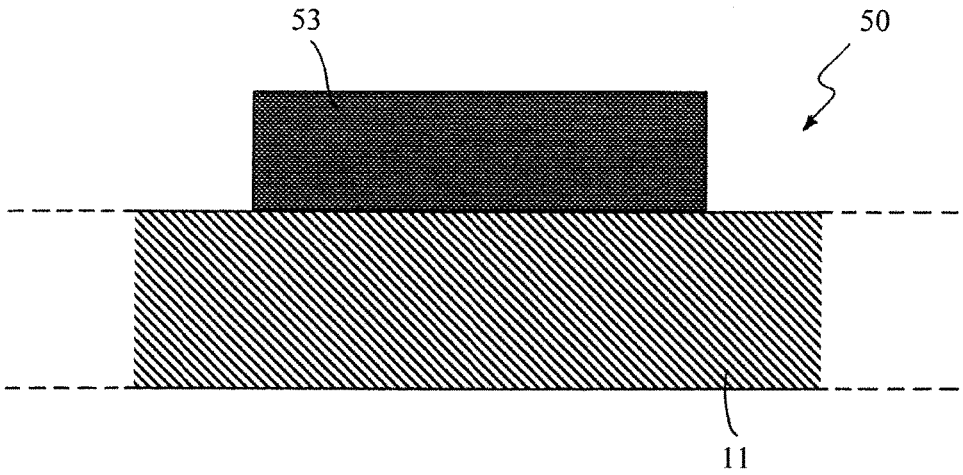
FIG. 5 represents a sectional and cut-away view of a dispenser of the invention realized according to a second modality.

FIG. 5 represents a section and cut-away view of a support of the invention, 50, realized according to the second cited modality, in its more general embodiment.

In this case on support 11 is present a deposit 53 of getter material into which an evaporable metal is dispersed. The evaporable metal is trapped and shielded by the getter structure and is released during a suitable thermal treatment of the latter, similar to what happens with the supports realized according to the first modality. The deposits of getter material having dispersed inside an evaporable metal according to this embodiment may have a thickness comprised between 100 nm and 10 μm, with a weight percentage of the metal comprised between 1 and 20%, preferably between 3 and 10% of the total weight of the deposit.

Figure 6:
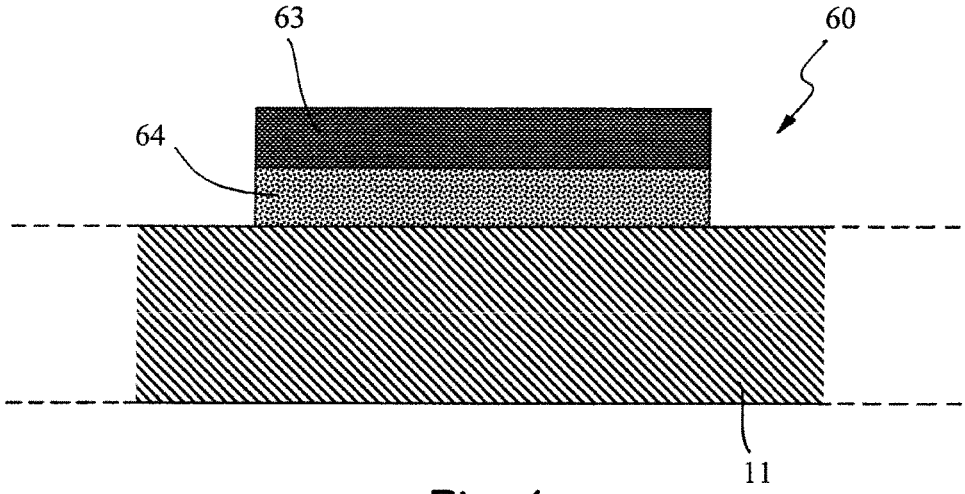
FIG. 6 represents a sectional and cut-away view of a variation of the support of FIG. 5.

In this modality as well, it is possible to adopt the use of a barrier layer that insulates the volume where the evaporable metal is present from contact with the support. A structure of this kind is shown in FIG. 6: dispenser 60 is formed by support 11 on which is present a barrier layer 64, and on this a deposit 63 of getter material in which is dispersed the evaporable metal. The thickness of layer 64 may be comprised between 100 nm and 10 μm. Barrier layer 64 may be made of the same getter material used for deposit 63 or of a different material, chosen among the materials previously cited for performing this function.

Clearly, in all embodiments so far described, the sum of thicknesses of the various layers and deposits cited must be compatible with the realization of the final device in which the dispenser must be present, or with the process for manufacturing the same. In thermotunneling refrigerating units, for instance, cathode and anode are very close to each other, spaced apart a distance on the order of a few tens of nanometers. In this case, if one of the electrodes (e.g., the cathode) is built on the same support 11 of the dispenser, the sum of the thickness values of the different deposits and layers making up the dispenser of the invention must be such that the two electrodes are not shorted, and preferably not higher than the thickness of the electrode on support 11.

The dispensers of the invention may comprise an integrated heater (case not shown in the drawings). With this measure it is possible to have a better control of the process of getter activation and evaporation of the evaporable metal. Furthermore, in case the support of the dispenser forms a part of the walls of the cavity of the final device, the presence of the integrated heater also allows subsequent reactivations of the getter, in order to reinstate its sorbing capability during the life of said device. The heater may be a resistance (formed, e.g., via depositing by screen-printing one or more tracks of a paste of resistive material) placed on the side of support 11 opposed to the one where the deposits of getter material and evaporable metals are obtained. Alternatively, it is possible to have the heater on the same side of the support where said deposits are present, providing feedthroughs for its power supply and forming the deposits characteristic of the invention on the heater area. A solution of this kind, for the heating of getter layers in the cavities of micromechanical devices, is described in International Patent Application No. WO 2004/065289 in the name of the present applicant.

In a second aspect thereof, the invention consists in a process for producing the dispensers described above.

The dispensers of the invention are produced with techniques typical of the semiconductors industry, with subsequent depositions of the various materials, delimiting the area of the support onto which the depositions take place by masking.

As a source of evaporable metal it is possible to use a source based on controlled thermal evaporation, such as shown for instance in patent application WO 2006/057021 in the name of the applicant. The evaporable metal is produced in the form of a deposit by evaporation and condensation on the support. The duration of the deposition process controls the thickness of the layer produced, while the regions onto which the deposition takes place are selected through a suitable masking of the support. As is well known, masking may be mechanical and realized with a self-standing mask, generally a thin metallic foil with openings having shape, dimensions, and placement on the mask corresponding to those of the desired deposits. Alternatively, it is possible to adopt masks produced in-situ, directly on the support, with polymeric materials that can be selectively removed, for instance following sensitization with UV radiation and subsequent removal of the sensitized (or non-sensitized) areas by chemical etching. Maskings of the second kind are more suitable when deposits with small lateral dimensions, generally below 100 μm, are to be obtained, while maskings of the first kind can be sufficient for higher dimensions.

After deposition of the evaporable metal, deposition of the getter material layer is carried out, typically by sputtering. The sputtering technique is widely known in the field of deposition of thin layers, and does not require a detailed description here. Its application to getter materials is described, for instance, in U.S. Pat. No. 6,468,043 and in International Patent Application Publication No. WO 2006/109343. For the obtainment of porous getter layers, optimized for obtaining good values of gas sorption speed, it is preferable to operate according to the special conditions taught in this latter document, namely, working with a relatively high pressure of gas (generally argon) in the chamber and a low power applied between target and support, and preferably keeping cool the support onto which deposition is performed and with a high distance between target and support. Vice versa, for the production of getter layers with barrier functionality (such as layer 44 previously described), it is preferable to operate with such conditions as to obtain dense deposits, which are the conditions typical of sputtering processes, that is, low gas pressure in chamber, high electrical power applied, non-cooled support and low distance target-support.

In order to realize the invention in its first modality it is necessary that the lateral dimensions of the deposit of evaporable metal be lower than those of the overlying getter material layer. As a consequence, it is necessary to use at least two different masks: a first mask with openings of lower dimensions for depositing the evaporable metal and a second mask with openings of greater dimensions for depositing the getter material.

In the case of the support of FIG. 2, the second mask (wider openings) is employed at the beginning to effect the deposition of the barrier layer (24), then the first mask for the deposition of the evaporable metal (22), and finally the second mask is used again for the deposition of the getter material (23). The barrier layer, when this is not realized with getter material, can be deposited with techniques like evaporation, sputtering and "Chemical Vapor Deposition", that provide for layers with high density and thus with good barrier properties.

From the production process standpoint, the support of FIG. 3 turns out to be preferable, as it allows for the use of the first mask (the one with openings with lower dimensions) for the production of the barrier layer (34) and subsequently of the deposit of evaporable metal (32), and then employment of the second mask for depositing the getter material (33). In this way an operation of mask substitution is saved, which would imply dead-times and criticalities annexed to the need of precise alignment of masks in subsequent depositions.

In the above described processes, the deposition chamber for forming the deposits of evaporable metal and of getter material may be the same or the support may be transferred between two connected chambers, one dedicated to sputtering processes and the other to evaporation processes.

In case a support as the one shown in FIG. 5 is produced, the upper layer of getter material having dispersed inside the evaporable metal may be produced using the sputtering technique alone, starting with a target made in its turn of getter material with dispersed therein the desired metal or by co-deposition, carrying out simultaneously the deposition of the getter material through sputtering and that of the evaporable metal through evaporation. This second operation mode is known and deposition systems suitable to carry it out exist (for instance, the IonCell systems produced by Plasmion Corp. of Hoboken, N.J., USA).

In the case of production of a dispenser as described with reference to FIG. 6 (dispenser 60), this is best accomplished in a single chamber and during an uninterrupted process, by first depositing layer 64 of pure getter material, and as soon as the desired thickness for layer 64 is reached, by starting co-deposition of the same getter material along with the desired evaporable metal.

Although the dispensers of the invention can be produced one-by-one, preferably they are produced in processes typical of the semiconductor industry, in which on a common support (e.g., a silicon wafer), operating with suitable maskings (as it is well known in the field) a plurality of dispensers are produced. They are then suitably singled out at the end of the process in order to produce the final dispensers. The wafer with a multiplicity of dispensers can also be joined to another wafer carrying a corresponding number of active elements of final devices (e.g., thermotunneling refrigerating units), and the assembly of the two wafers separated into single devices when these are completed (a technique known in the field as "dicing").

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A dispenser of an alkali or alkaline-earth metal stable to environmental gases, wherein the dispenser comprises a support carrying a deposit of a getter material and wherein the dispenser contains a deposit of an alkali or alkaline-earth metal and releases the alkali or alkaline-earth metal, and wherein the alkali or alkaline-earth metal is in a form of elemental metal in contact with and completely covered by said deposit of getter material, wherein the alkali or alkaline-earth metal is mechanically and chemically protected from the environment by being in contact with said deposit of getter material, and wherein said getter material is selected from the group consisting of hafnium, niobium, vanadium, titanium, zirconium, and titanium- and/or zirconium-based alloys with one or more elements selected from transition elements, Rare Earths and aluminum.

2. The dispenser according to claim 1, wherein the support comprises a material selected from the group consisting of metals, metal alloys, semiconductors, glasses and ceramic materials.

3. The dispenser according to claim 2, wherein said material is selected from the group consisting of kovar, silicon, germanium, silicon carbide, sapphire, quartz, glass, pyrex, indium phosphide and gallium arsenide.

4. The dispenser according to claim 1, wherein said alkali or alkaline-earth metal is selected from the group consisting of lithium, sodium, potassium, rubidium, cesium, magnesium, calcium, strontium and barium.

5. The dispenser according to claim 1, further comprising a barrier layer between said deposit of alkali or alkaline-earth metal and said support.

6. The dispenser according to claim 5, wherein said barrier layer comprises a material selected from the group consisting of tantalum, platinum, gold, combinations of these metals, titanium nitride, silicon nitride and a getter material.

7. The dispenser according to claim 1, wherein a thickness of said deposit of alkali or alkaline-earth metal is comprised between 1 and 100 nm.

8. The dispenser according to claim 7, wherein said thickness is comprised between 10 and 50 nm.

9. The dispenser according to claim 1, wherein a thickness of said deposit of getter material is comprised between 100 nm and 1 μm.

10. The dispenser according to claim 5, wherein said barrier layer has a thickness comprised between 100 nm and 1 μm.

11. The dispenser according to claim 5, wherein said deposit of getter material and said barrier layer have the same lateral dimensions.

12. The dispenser according to claim 5, wherein said deposit of alkali or alkaline-earth metal and said barrier layer have the same lateral dimensions.

13. The dispenser according to claim 1, wherein the getter material and its thickness are selected so that the getter material will fracture prior to deposition of the alkali or alkaline-earth metal.

14. The dispenser according to claim 4, wherein the alkali or alkaline-earth metal is cesium.

* * * * *